US008517285B2

(12) United States Patent
Sandford

(10) Patent No.: US 8,517,285 B2
(45) Date of Patent: Aug. 27, 2013

(54) CHILLED POWDER FIRE EXTINGUISHER

(76) Inventor: Geoffrey Paul Sandford, Artarmon (AU)

( * ) Notice: Subject to any disclaimer, the term of this patent is extended or adjusted under 35 U.S.C. 154(b) by 469 days.

(21) Appl. No.: 12/598,373

(22) PCT Filed: May 7, 2008

(86) PCT No.: PCT/AU2008/000632
§ 371 (c)(1),
(2), (4) Date: Dec. 3, 2009

(87) PCT Pub. No.: WO2008/138035
PCT Pub. Date: Nov. 20, 2008

(65) Prior Publication Data

US 2010/0132961 A1 Jun. 3, 2010

(30) Foreign Application Priority Data

May 10, 2007 (AU) ..... 2007902483

(51) Int. Cl.
*A62C 15/00* (2006.01)

(52) U.S. Cl.
USPC ..... 239/154; 118/302; 118/308; 261/130

(58) Field of Classification Search
USPC .. 239/152, 44, 145, 326, 41, 42; 261/DIG. 4, 261/DIG. 41, DIG. 15; 222/187; 118/302, 118/308, 323
See application file for complete search history.

(56) References Cited

U.S. PATENT DOCUMENTS

| | | | | |
|---|---|---|---|---|
| 2,561,592 | A * | 7/1951 | Palmer | 261/24 |
| 7,021,391 | B2 * | 4/2006 | Schasteen | 169/14 |
| 7,449,068 | B2 * | 11/2008 | Lichtblau | 118/302 |

FOREIGN PATENT DOCUMENTS

| | | | |
|---|---|---|---|
| FR | 2781382 | A1 | 1/2001 |
| RU | 2278711 | C1 | 6/2006 |
| WO | WO 2005/018748 | A1 | 3/2005 |

* cited by examiner

*Primary Examiner* — Len Tran
*Assistant Examiner* — Viet Le
(74) *Attorney, Agent, or Firm* — Daniel Schein, Esq.

(57) ABSTRACT

A fire extinguisher comprises a conduit having an air inlet and outlet. A blower unit is used for delivering a stream of air from said inlet to said outlet for extinguishing a fire. The extinguisher includes a cooling device using water to cool the stream of air entering said inlet prior to it being delivered to said fire via said outlet, and a powder delivery system for injecting and mixing a powder into said cooled stream of air prior to it leaving said outlet. The cooling device utilizing a tiny fraction of water to cool air as it passes there through.

15 Claims, 8 Drawing Sheets

14
15
15b
20a
20
21
19

1b
18

19
20
21
1a 15b
18
15, 15a

1b

CHILLED POWDER FIRE EXTINGUISHER

TECHNICAL FIELD

The present invention relates to a fire extinguisher. In particular the present invention relates to a chilled powder fire extinguisher. The present invention is described primarily with a hand carried fire extinguisher, however a trolley mounted fire extinguisher and a fire extinguisher capable of being mounted on a vehicle are also described.

BACKGROUND

In Australia and many other countries, bush and forest fires pose a threat to residential and rural properties. Typically, fires which extend over a large expanse, such as in a bush or forest fire, industrial or chemical fires, present particular problems in regard to delivering dousing materials and/or fire retardants quickly and precisely over threatened areas, whilst minimising risks to fire fighters and surrounding assets. Conventional fire fighting techniques involve controlling the progress of a fire at a perimeter, which may involve back burning.

In the case of bush and forest fires that typically pose a threat to residential and rural properties in hot dry weather, airborne burning materials can start spot-fires that reach residences and other assets when the fire front has not reached the same location. In most instances owners of such properties may have difficulty with putting out such fires with conventional garden hoses or fire extinguishers, and are helpless at stopping the fire causing damage to the their property and assets.

The disadvantage of garden (and other) hoses is that they require large volumes of water, and in some instances they are not able to adequately reach the location of the fire. Even in situations where large volumes of water are available, the use of water hosed thereon can result in the damage to the assets. Large volumes of water sprayed on to assets can also create further problems in other fire fighting scenarios. For example, where a fire has taken place on a small boat, too much water sprayed thereon may cause other safety issues, such as the sinking or partial sinking of the boat.

Also, the disadvantage of a conventional hand-carried pressurised fire extinguisher of the type containing foam or "dry chemicals", is that it generally only has a short period of operation and of use for a very small fire. Such a conventional fire extinguisher is not effective for a scenario where a property owner may have to put out a number of spot fires that are threatening his/her property.

The present invention seeks to provide a fire extinguisher that will ameliorate or overcome at least one of the deficiencies of the prior art.

SUMMARY OF INVENTION

According to a first aspect the present invention consists in a fire extinguisher comprising a conduit having an air inlet and an air outlet, a blower unit for delivering a stream of air from said inlet to said outlet for extinguishing a fire, a cooling device using water to cool the stream of air entering said inlet prior to it being delivered to said fire via said outlet, and a powder delivery system for injecting and mixing a powder into said cooled stream of air prior to it leaving said outlet, wherein said stream of air is cooled by at least 20° C. by a relatively tiny fraction of water.

Preferably one mass unit of water is able to cool no less than one hundred mass units of air.

Preferably said water cools said air rapidly.

Preferably said water cools said air in less than 0.05 seconds.

Preferably said cooling device comprising a drip feed assembly arranged to drip feed water from a first reservoir onto a water absorbent medium disposed at or near said air inlet, and a mist evaporator assembly disposed downstream of said inlet.

Preferably said mist evaporative assembly comprises at least one helically shaped panel.

Preferably said panel includes paper with activated carbon attached thereto or integral therewith.

Preferably said mist evaporative assembly comprises a medium for removing non-vaporised water downstream of said at least one helically shaped panel.

Preferably said powder delivery system includes a venturi nozzle through which said powder is injected into the cooled stream of air prior to exiting said outlet.

Preferably said powder delivery system further comprises an auger assembly for delivering powder stored in a second reservoir to said venturi nozzle.

Preferably said fire extinguisher is a portable hand-carried extinguisher.

Preferably said blower unit is a liquid fuel powered device.

Preferably said powder delivery system is battery powered.

Preferably water can be delivered to said first reservoir from a remotely located water tank.

Preferably in one embodiment said fire extinguisher is a portable hand-carried extinguisher, and said remotely located water tank is a back pack water tank which gravity feeds water to said first reservoir.

Preferably in another embodiment said fire extinguisher is mounted on a wheeled trolley.

Preferably in an even further embodiment said extinguisher is mounted on a land or water vessel, and said outlet of said conduit is operably supported and oriented by a crane structure.

According to a second aspect the present invention consists in a portable hand-carried fire extinguisher comprising: a conduit having an air inlet and an air outlet, a blower unit for delivering a stream of air from said inlet to said outlet for extinguishing a fire, a cooling device using a tiny fraction of water relative to the air to cool the stream of air entering said inlet prior to it being delivered to said fire via said outlet, said cooling device comprising a drip feed assembly arranged to drip feed water from a first reservoir onto a water absorbent medium disposed at or near said air inlet, and a mist evaporator assembly disposed downstream of said inlet, and a powder delivery system for injecting and mixing a powder into said cooled stream of air prior to it leaving said outlet, said powder delivery includes a venturi nozzle through which said powder is injected into the cooled stream of air prior to exiting said outlet and an auger assembly for delivering powder stored in a second reservoir to said venturi nozzle.

BRIEF DESCRIPTION OF DRAWINGS

FIG. 3(*b*) shows an enlarged partial perspective view of helically-shaped panel component of the mist evaporative assembly of FIG. 3(*a*).

FIG. 3(*c*) shows an enlarged schematic cross-sectional view of helically-shaped panel component of the mist evaporative assembly of FIG. 3(*b*).

FIG. 3(*d*) shows an enlarged schematic partial perspective view of the final filter component of the mist evaporative assembly of FIG. 1.

FIG. 3(*e*) shows an enlarged schematic cross-sectional view of the components of the final filter shown in FIG. 3(*d*).

FIG. 5(*b*) shows an end view of the venturi nozzle of the powder delivery system of the extinguisher shown in FIG. 1.

FIG. 7(*b*) shows a plan schematic view of a fire extinguisher shown in FIG. 7(*a*).

DESCRIPTION OF PREFERRED EMBODIMENTS

Figure 1:
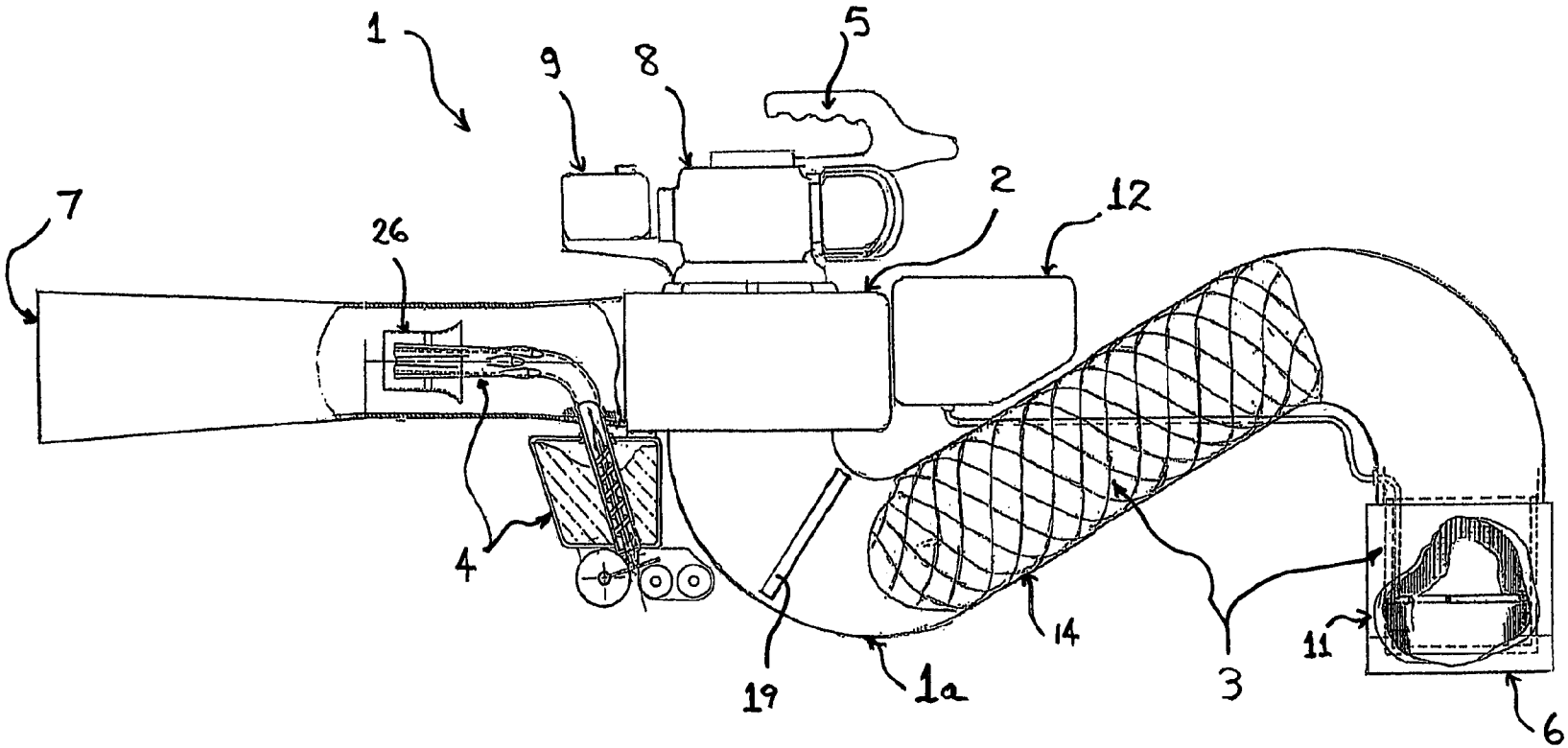
FIG. 1 shows an elevational schematic view of a fire extinguisher in accordance with a first embodiment of the present invention.

FIGS. 1-6 describe a first embodiment of a portable hand-carried fire extinguisher 1 in accordance with the present invention. The fire extinguisher 1 is preferably about 1.5 m long and capable of both cooling and asphyxiating a fire. The extinguisher 1 is essentially an air conduit 1*a* comprising a centrally disposed blower unit 2 and having an air inlet 6 and an outlet (exit) 7. Extinguisher 1 also comprises a cooling system 3 and a powder delivery system 4. Extinguisher 1 also has a handle 5.

The blower unit 2 is driven via a drive shaft by a gasoline engine 8 of about 2.5 kw, in fluid communication with a gasoline reservoir (tank) 9.

An oil sponge 13 located at inlet 6 acts as an initial filter to prevent debris and larger particulate matter entering air conduit 1*a*.

Figure 2:
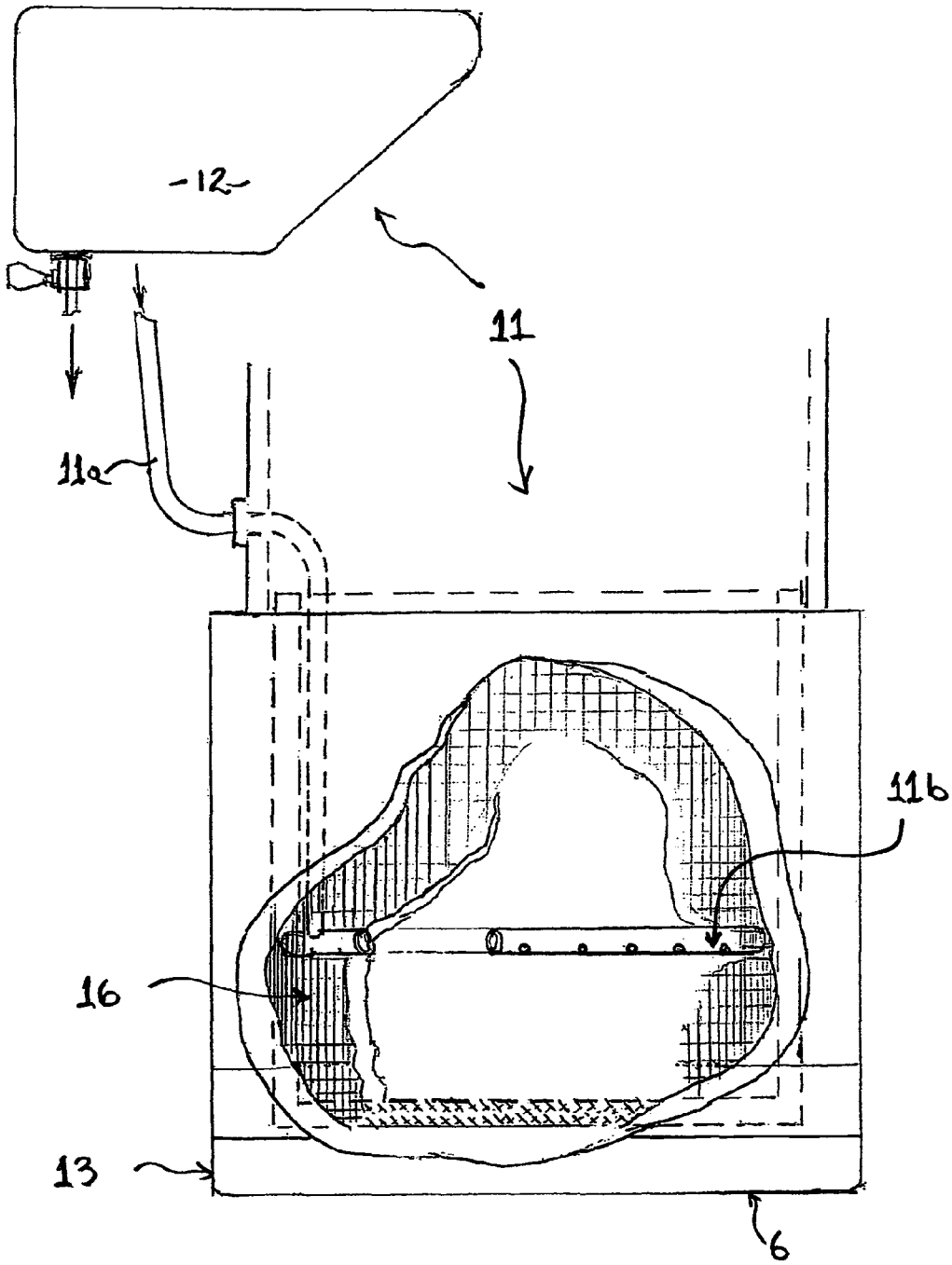
FIG. 2 shows an enlarged schematic view of the drip feed assembly of the cooling system of the extinguisher shown in FIG. 1.
Figures 3A, 3B, 3C, 3D, 3E:
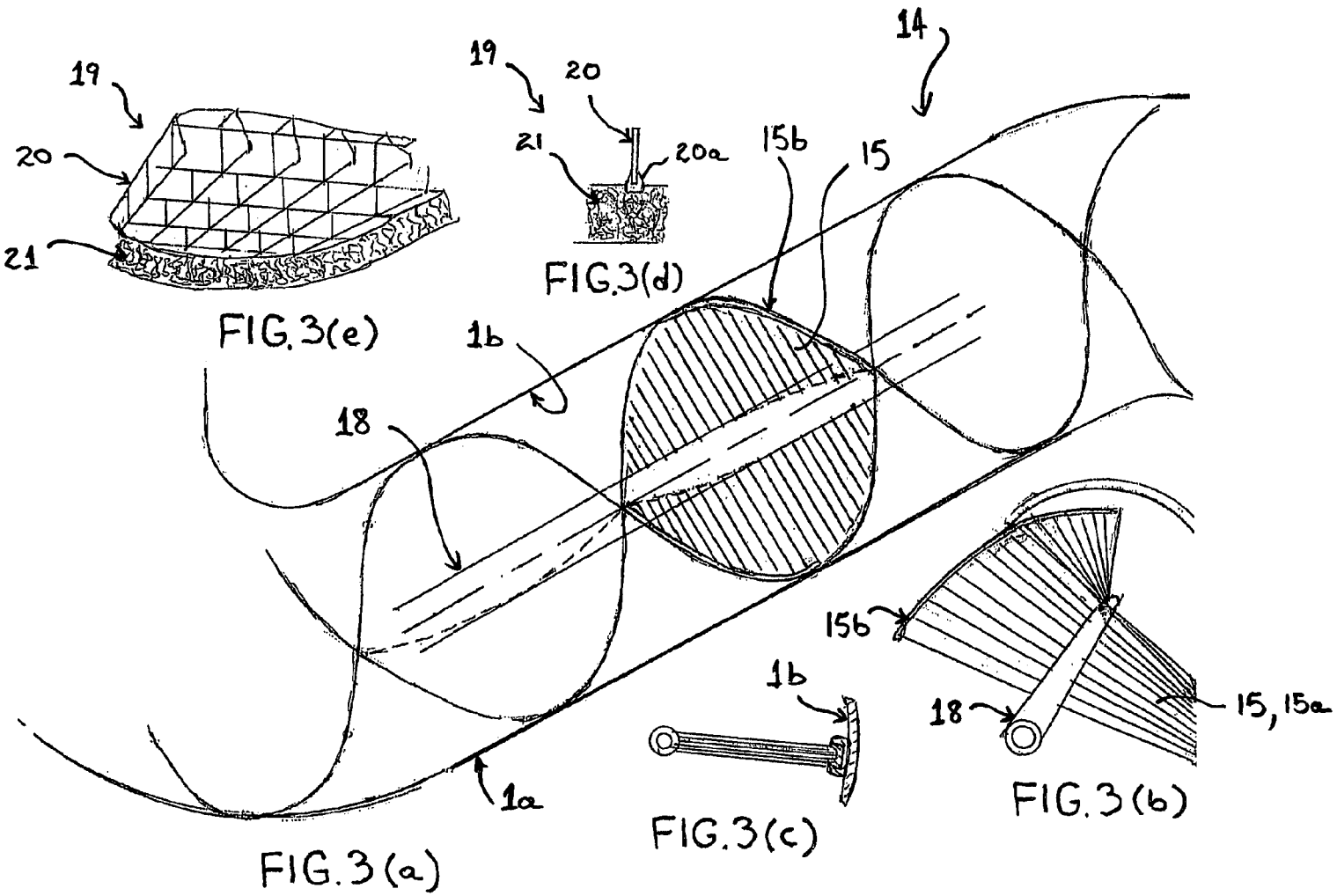
FIG. 3(*a*) shows an enlarged schematic view of the mist evaporative assembly of the cooling system of FIG. 1.
Figure 4:
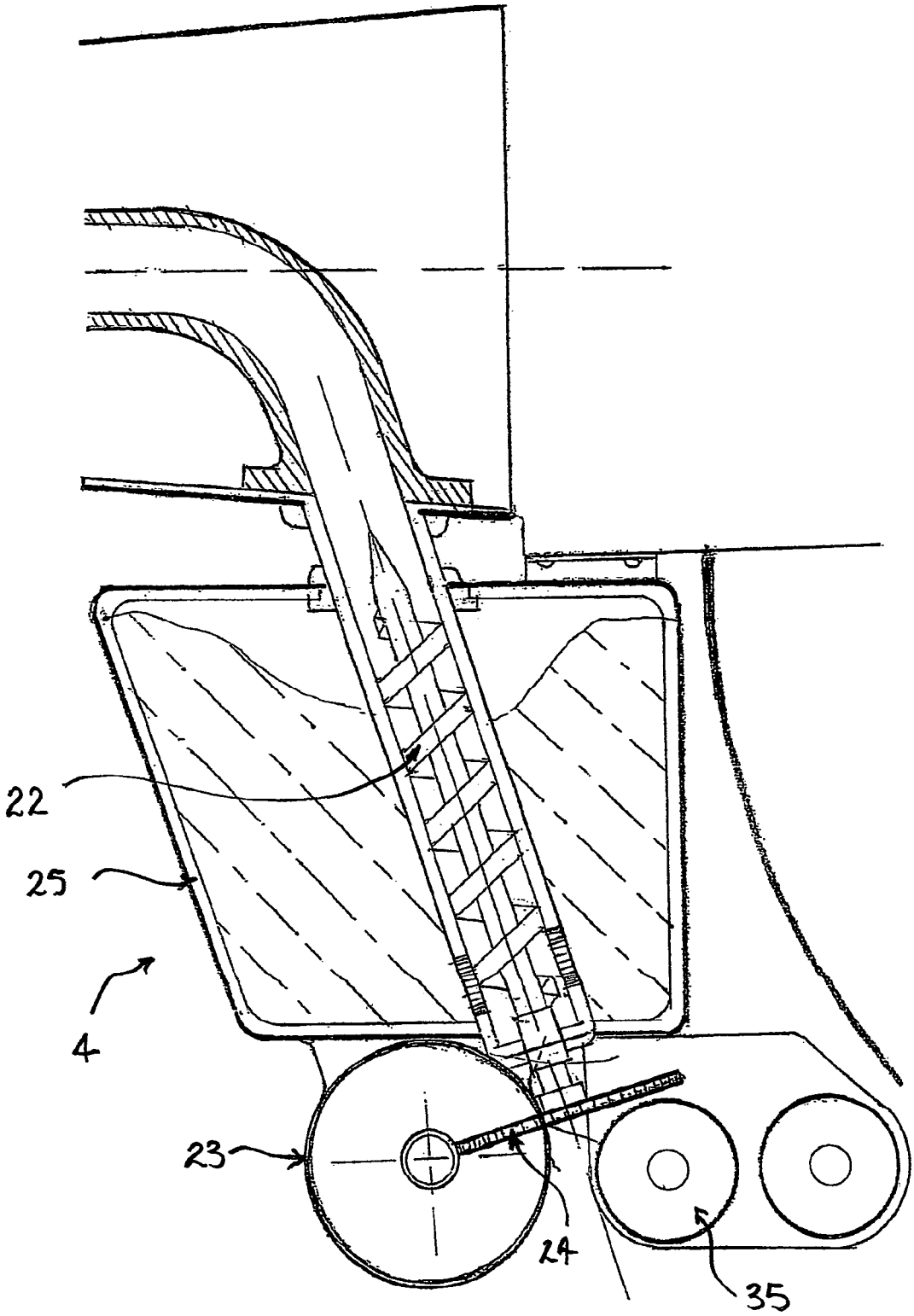
FIG. 4 shows an enlarged schematic view of the auger arrangement of the powder delivery system of the extinguisher shown in FIG. 1.
Figure 5B:
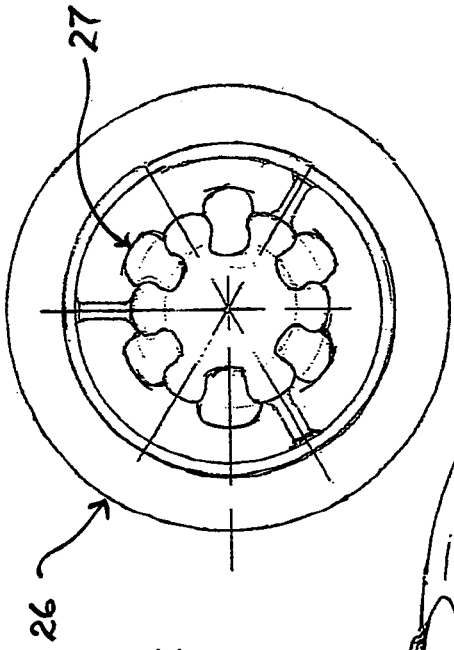
FIG. 5(*a*) shows an enlarged partial cross-sectional schematic view of the venturi nozzle of the powder delivery system of the extinguisher shown in FIG. 1.
Figure 5A:
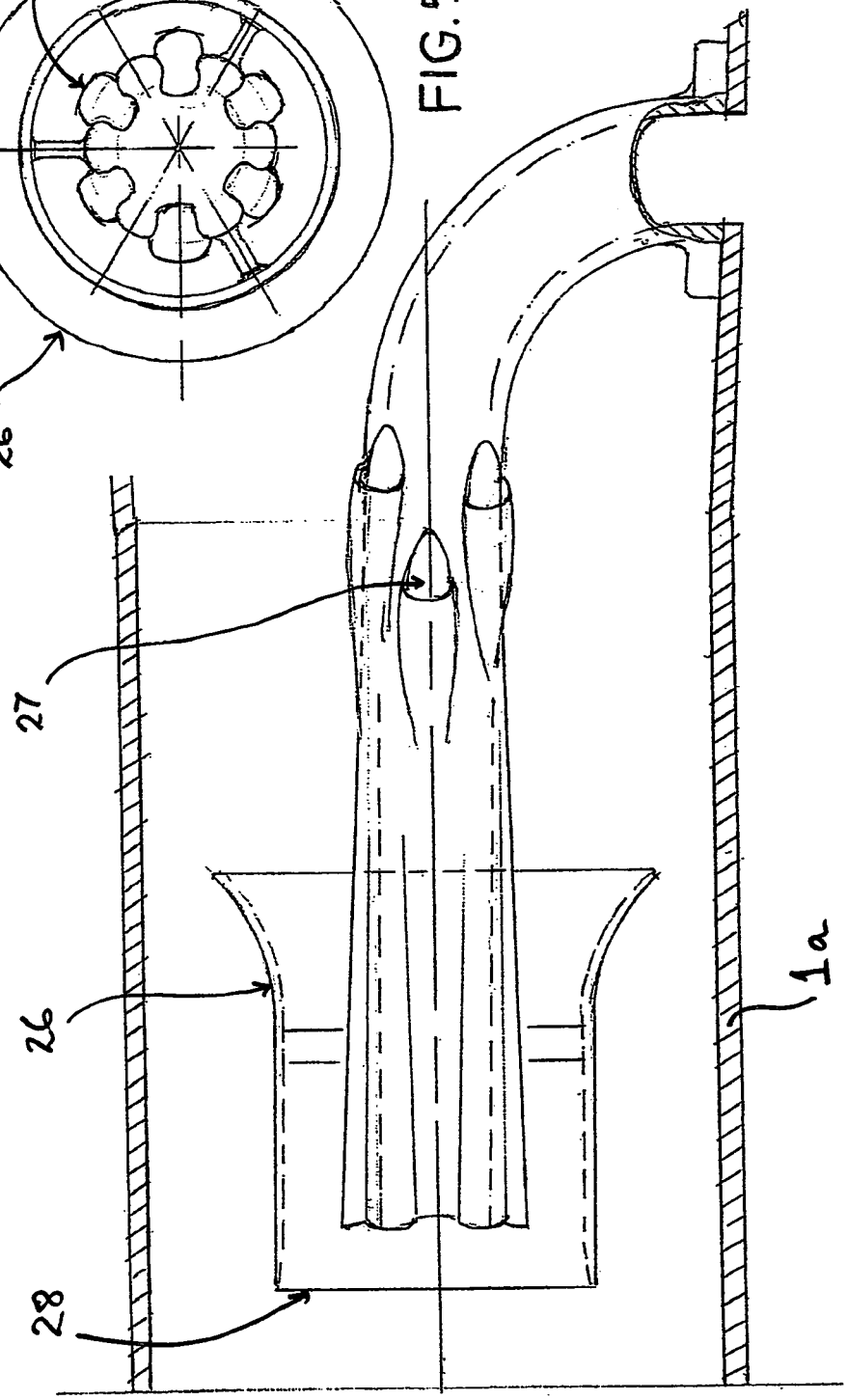
Figure 6:
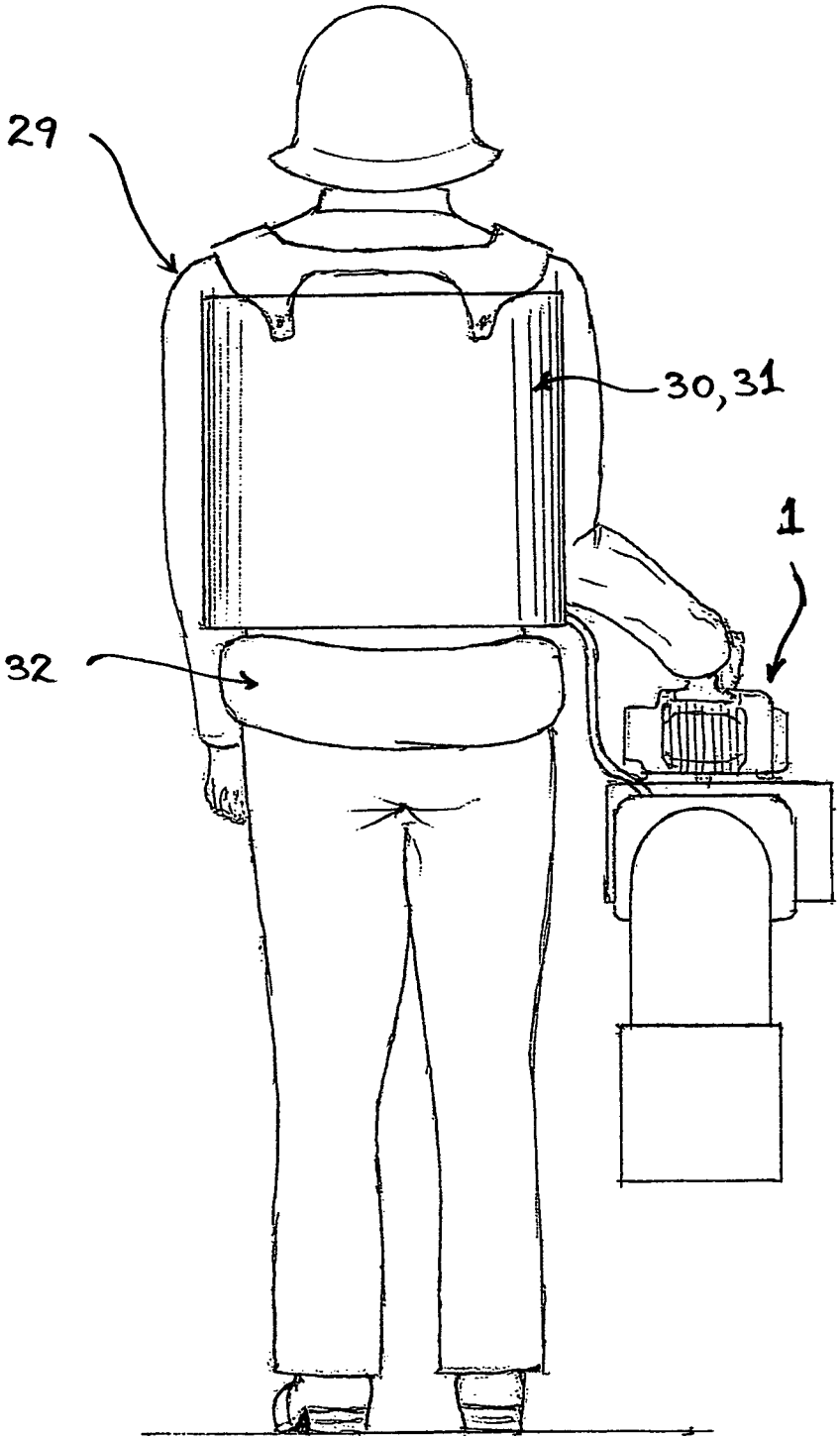
FIG. 6 shows a user carrying the extinguisher shown in FIG. 1.

Cooling system 3 comprises a drip feed assembly 11, as shown in FIG. 2, adapted to drip feed water from a water reservoir 12 to a water absorbent medium 16, disposed internally near air inlet 6. This water absorbent medium 16 may include a combination of materials such as filter wool, carbon black and chalk. Drip feed assembly 11 comprises a pipe 11*a* that interconnects reservoir 12 with a circular shaped tube 11*b* having a plurality of very fine apertures therein for dripping water on water absorbent medium 16.

Cooling system 3 also comprises a mist evaporative assembly 14 having a helically shaped panel (or array of panels) 15. The panel 15 is sheet like and due to its helical shape looks similar to a "twisted ribbon". Preferably it has a paper (cardboard) sheet material 15*a* coated or impregnated with activated carbon supported by a plastic or metal wire support structure 15*b*. For example, activated carbon granules may be glued onto paper 15*a*.

Where a single panel 15 is used it can be supported within the bore solely by the inner wall 1*b* of air conduit 1*a*. However, where an array of panels 15 is used they may be disposed between the wall 1*b* of conduit and a central supporting member 18.

In use, when blower unit 2 is operating and drawing air there through, water that is absorbed by medium 16 comes in contact with the air entering the inlet 6, via oil sponge 13. The air gains humidity (moisture) as it passes through the medium 16. The fast moving air has an opportunity for absorption (evaporation of water) as it passes through panels 15 of mist evaporative assembly 14. This is because larger droplets of water strike panel(s) 15 and this further enhances the evaporation of water.

A final filter 19, comprising a metal grate 20 and absorbent medium 21, such as an oil sponge with activated carbon is disposed downstream of panel(s) 15. The purpose of metal grate 20 is to support and restrain medium 21. Any non-vaporised water is removed from the airstream by medium 21 as it passes through final filter 19. The metal grate 20 may be prevented from cutting into filter medium 21 by plastic elements 20*a*.

During operation of the extinguisher 1 on a hot dry day when the ambient temperature near a spot fire may be about 40° C. as it enters inlet 6, the cooling system 3 is capable of rapidly cooling/chilling the air to about 10-15° C., thereby reducing the air temperature by more than 20° C., and preferably by more than 25° C.

This cooling action is efficient because the latent heat of evaporation of water is very high, about 540 Kcal/Kgm and the specific heat of air at constant pressure is just 0.23 (conservatively selected and depending on conditions may be a lower figure such as 0.16). These two facts mean that one mass unit of water may cool (chill) by 25° C., no less than one hundred and twenty mass units of air. This means that 1 kg (about 1 liter) of water may cool about 90 cubic meters of air. In the above abovementioned embodiment this 1 kg of water may cool 90 cubic meters air in about four minutes of operation of extinguisher 1.

What this means is that only a tiny fraction of water is used to cool/chill a relatively much larger amount of air. By "tiny fraction" this means a single mass unit of water can be used to cool (chill) by at least 20° C., no less than one hundred mass units of air.

The cooling action as described above by means of the drip feed assembly 11 and mist evaporative assembly 14 enable the required extremely rapid absorption and evaporation of water into air, in less than 0.05 seconds. As such the "rapid cooling action" takes place in very small fraction of time.

Once the cooled air has passed final filter 19 and flows towards outlet 7, it has a very fine powder, such as bicarbonate soda (baking soda), injected and mixed therein by a powder delivery system 4. This mixture of cooled air and powder is capable of extinguishing established fires.

The powder delivery system 4 comprises an auger 22, driven by a small electric motor 23 via reduction gear 24. The electric motor 23 is powered by a conventional disposable or rechargeable battery 35. The auger 22 delivers powder stored in reservoir 25 to a venturi nozzle 26.

A portion of the cooled air stream passing through air conduit 1*b* enters venturi inlets 27 on nozzle 26, and enabling powder being delivered to nozzle 26 to be ejected through nozzle outlet 28, thereby injecting and mixing the fine powder into the cooled air stream. This cooled air/powder mixture then exits the extinguisher outlet 7 in stream like fashion. This cooled air/powder mixture is an effective way of extinguishing a fire with use of a very small amount of water for cooling purposes.

In use, the user 29 carries extinguisher 1 via handle 5. User 29 preferably wears a back-pack 30 having an upper water holding reservoir 31, and a separate powder storage reservoir 32. The water holding reservoir 31 may preferably be a fifteen liter water tank, whilst the separate powder storage reservoir 32, may be a flexible sack capable of carrying up to twelve kilograms of powder. When operating the extinguisher 1, the user 29 wearing back pack 30, is able to transfer water by gravity feed from reservoir 31 to reservoir 12 of extinguisher 1, via tube 33. This is because the bottom of reservoir 31 is preferably about fifteen centimeters above the user's waist.

The powder storage reservoir 32 enables the user 29 to refill the reservoir 25 (on extinguisher 1) with powder, if need be when operating in the field. This may also be achieved by a transfer tube (not shown) that may include a pressurised and/or vibrating transfer system. Whilst the powder storage reservoir 32 may be attached to backpack 30, it should be understood that it may also be in the form of a separate waist bag worn by user 29.

In the abovementioned embodiment, the gasoline engine 8 that drives the blower unit 2, may be of a similar type to that used on commercially available chainsaws, making the design and construction of the extinguisher 1 relatively inexpensive. However, it should be understood that in another not shown embodiment the engine and drive unit for the blower unit may be designed to incorporate an auxiliary drive for also driving the powder delivery system. This would eliminate the need for providing a battery powered electric motor for the powder delivery system of the above described embodiment.

It should be understood that whilst the powder used in the abovementioned embodiment is bicarbonate soda (baking soda), other suitable powder materials could be used alone or in combination with each other as the asphyxiating material.

An advantage of extinguisher 1 is that it can be used to extinguish fire utilizing a very small amount of water. This firstly means that it is portable and can be used in situations where large amounts of water are not available, and secondly can be used in locations where residential hoses do not reach. Thirdly, because only a small amount of water is used, there is less likelihood of assets being protected being water damaged by the extinguisher.

Figures 7A, 7B:
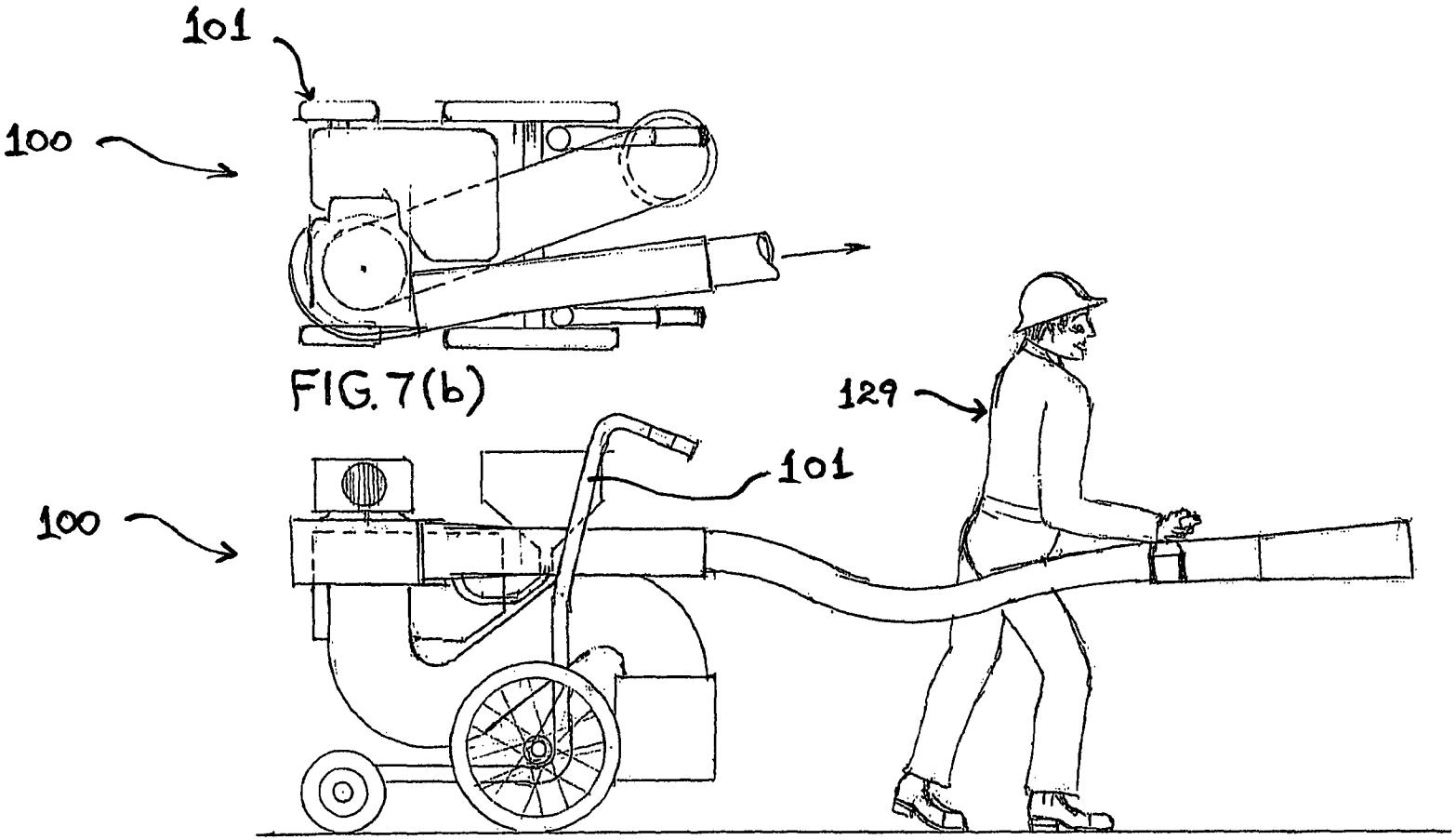
FIG. 7(*a*) shows an elevational schematic view of a fire extinguisher in accordance with a second embodiment of the present invention along with a user thereof.

Whilst the above mentioned extinguisher 1 and backpack 30, is suitable for use by an average sized adult of reasonable fitness, it may possibly not be suited for use by elderly, in-firm or smaller statured adults. However, a second embodiment of the present invention, namely a trolley mounted fire extinguisher 100 shown in FIGS. 7(*a*)-(*b*), may be operated by adults of various stature, age and fitness. This extinguisher 100 may have a cooling system for cooling air passing through a blower unit and a powder delivery system for delivering powder into the chilled (cooled) air, similar to that of the earlier described first embodiment. In such an embodiment the extinguisher 100 and the reservoirs of water and powder are all carried on trolley 101. Like that of the earlier described first embodiment, only a tiny fraction of water is used to cool/chill a relatively much larger amount of air. FIG. 7(*b*) shows extinguisher 100 being operated by user 129.

Figure 8:
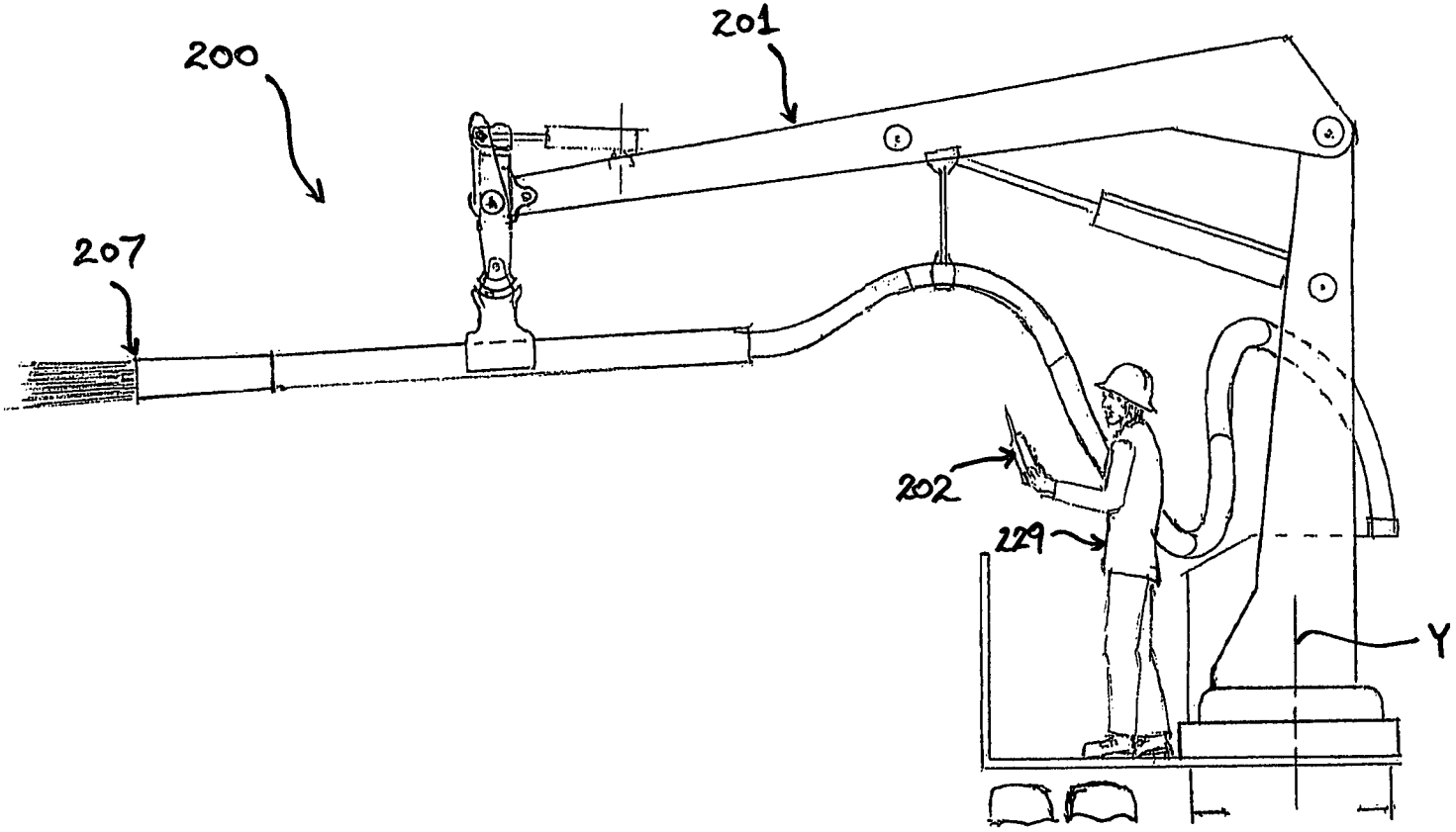
FIG. 8 shows an elevational schematic view of a fire extinguisher in accordance with a third embodiment of the present invention along with a user thereof.

In a third embodiment of the present invention as shown in FIG. 8, an extinguisher 200 may be of a larger size suitable for mounting on a land vessel such as wheeled utility vehicle, or a road or railway truck, or possibly even a water vessel. In such an embodiment, extinguisher 200 may have a cooling system for cooling air passing through a blower unit and a powder delivery system for delivering powder into the chilled (cooled) air, similar to that of the earlier described first embodiment. In such an embodiment the extinguisher 200 and the reservoirs of water and powder are all carried on the vessel. Due to its large size the cooling system and delivery system would have a delivery capacity much greater than that of the earlier described extinguishers 1 and 100. However, like that of both the first and second embodiments, it would operate on the same principle where one mass unit of water will cool by at least 20° C., no less than one hundred mass units of air.

The outlet 207 at the front end of the extinguisher 200 is supported by a crane-like pivotal support structure 201, that allows for rotational positioning thereof about an axis Y, and pitch positioning thereof. Due to its large size the positioning of the outlet 207 of extinguisher 200 may be carried out by a user 229 utilising a remote control unit 202 for positioning and control device.

When operating any of the abovementioned fire extinguishers 1, 100 or 200, a user will for safety and health reasons be required to wear a suitable face mask and/or breathing filtration apparatus, as such extinguishers may deliver high concentrations of powder in the surrounding environment.

The terms "comprising" and "including" (and their grammatical variations) as used herein are used in inclusive sense and not in the exclusive sense of "consisting only of".

The invention claimed is:

1. A fire extinguisher comprising a conduit having an air inlet and an air outlet, a blower unit for delivering a stream of air from said inlet to said outlet for extinguishing a fire, a cooling device using water to cool the stream of air entering said inlet prior to it being delivered to said fire via said outlet, and a powder delivery system for injecting and mixing a powder into said cooled stream of air prior to it leaving said outlet, wherein said cooling device comprises a drip feed assembly arranged to drip feed water from a first reservoir onto a water absorbent medium disposed at or near said air inlet, and a mist evaporator assembly disposed downstream of said inlet.

2. A fire extinguisher as claimed in claim 1, wherein said mist evaporative assembly comprises at least one helically shaped panel.

3. A fire extinguisher as claimed in claim 2, wherein said panel includes paper with activated carbon attached thereto or integral therewith.

4. A fire extinguisher as claimed in claim 2, wherein said mist evaporative assembly comprises a medium for removing non-vaporized water downstream of said at least one helically shaped panel.

5. A fire extinguisher as claimed in claim 1, wherein the powder delivery system includes a venturi nozzle through which said powder is injected into the cooled stream of air prior to exiting said outlet.

6. A fire extinguisher as claimed in claim 5, wherein said powder delivery system further comprises an auger assembly for delivering powder stored in a second reservoir to said venturi nozzle.

7. A fire extinguisher as claimed in claim 1, wherein said fire extinguisher is a portable hand-carried extinguisher.

8. A fire extinguisher as claimed in claim 1, wherein said blower unit is a liquid fuel powered device.

9. A fire extinguisher as claimed in claim 8, wherein said powder delivery system is battery powered.

10. A fire extinguisher as claimed in claim 1, wherein water can be delivered to said first reservoir from a remotely located water tank.

11. A fire extinguisher as claimed in claim 6, wherein said fire extinguisher is a portable hand-carried extinguisher, and said remotely located water tank is a back pack water tank which gravity feeds water to said first reservoir.

12. A fire extinguisher as claimed in claim 1, wherein said extinguisher is mounted on a wheeled trolley.

13. A fire extinguisher as claimed in claim 1, wherein said extinguisher is mounted on a land or water vessel, and said outlet of said conduit is operably supported and oriented by a crane structure.

14. A portable hand-carried fire extinguisher comprising: a conduit having an air inlet and an air outlet, a blower unit for delivering a stream of air from said inlet to said outlet for extinguishing a fire, a cooling device using a tiny fraction of water relative to the air to cool the stream of air entering said inlet prior to it being delivered to said fire via said outlet, said cooling device comprising a drip feed assembly arranged to drip feed water from a first reservoir onto a water absorbent medium disposed at or near said air inlet, and a mist evaporator assembly disposed downstream of said inlet, and a powder delivery system for injecting and mixing a powder into said cooled stream of air prior to it leaving said outlet, said powder delivery includes a venturi nozzle through which said powder is injected into the cooled stream of air prior to exiting said outlet and an auger assembly for delivering powder stored in a second reservoir to said venturi nozzle.

15. A fire extinguisher as claimed in claim 14, wherein said cooling device uses one mass unit of water to cool by at least 20° C. no less than one hundred mass units of air.

* * * * *